US010895426B2

(12) United States Patent
Robinson et al.

(10) Patent No.: US 10,895,426 B2
(45) Date of Patent: Jan. 19, 2021

(54) GAS TUBE ASSEMBLIES FOR GAS-ACTUATED FIREARMS

(71) Applicant: WHG Properties, LLC, North Wales, PA (US)

(72) Inventors: Frank E. Robinson, Schwenksville, PA (US); William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 42 days.

(21) Appl. No.: 16/048,592

(22) Filed: Jul. 30, 2018

(65) Prior Publication Data

US 2020/0033085 A1 Jan. 30, 2020

(51) Int. Cl.
*F41A 5/28* (2006.01)
*F41A 3/26* (2006.01)

(52) U.S. Cl.
CPC .. *F41A 5/28* (2013.01); *F41A 3/26* (2013.01)

(58) Field of Classification Search
CPC ..... F41A 5/26; F41A 5/28; F41A 5/18; F41A 5/24
See application file for complete search history.

(56) References Cited

U.S. PATENT DOCUMENTS

| | | | | |
|---|---|---|---|---|
| 8,807,011 | B2 | 8/2014 | Langevin | |
| 8,973,483 | B2 | 3/2015 | Sullivan | |
| 9,803,941 | B2 | 10/2017 | LaRue | |
| 9,857,129 | B1 * | 1/2018 | Kelly | F41A 5/28 |
| 9,903,675 | B2 | 2/2018 | Cassels | |
| 2013/0055883 | A1 | 3/2013 | Cassels | |
| 2014/0190344 | A1 | 7/2014 | Kenney | |
| 2016/0161200 | A1 * | 6/2016 | Windauer | F41A 5/28 89/193 |
| 2016/0178299 | A1 | 6/2016 | Cassels | |
| 2017/0003091 | A1 * | 1/2017 | Larue | F41A 5/26 |
| 2018/0180370 | A1 | 6/2018 | Zheng | |
| 2020/0116446 | A1 * | 4/2020 | Lynch | F41A 5/28 |

* cited by examiner

*Primary Examiner* — J. Woodrow Eldred
(74) *Attorney, Agent, or Firm* — Fox Rothschild LLP

(57) ABSTRACT

Gas tube assembles are provided for mounting on a gas block of a gas-actuated firearm having an internal passage configured to receive propellant gas from a barrel of the firearm. The gas tube assemblies have a gas tube that defines a passage extending between a forward and a rearward end of the gas tube. The gas tube assemblies also have a mating portion secured to the gas tube. The mating portion has a flange that can be secured to the gas block so that the flange prevents linear and rotational movement of the gas tube in relation to the gas block.

14 Claims, 14 Drawing Sheets

FIG. 14A
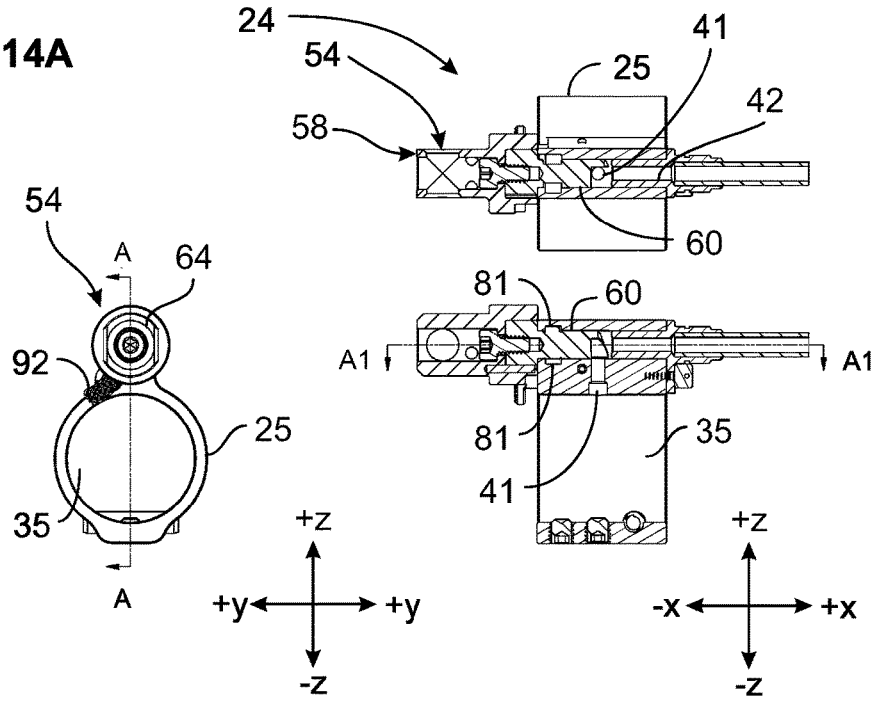
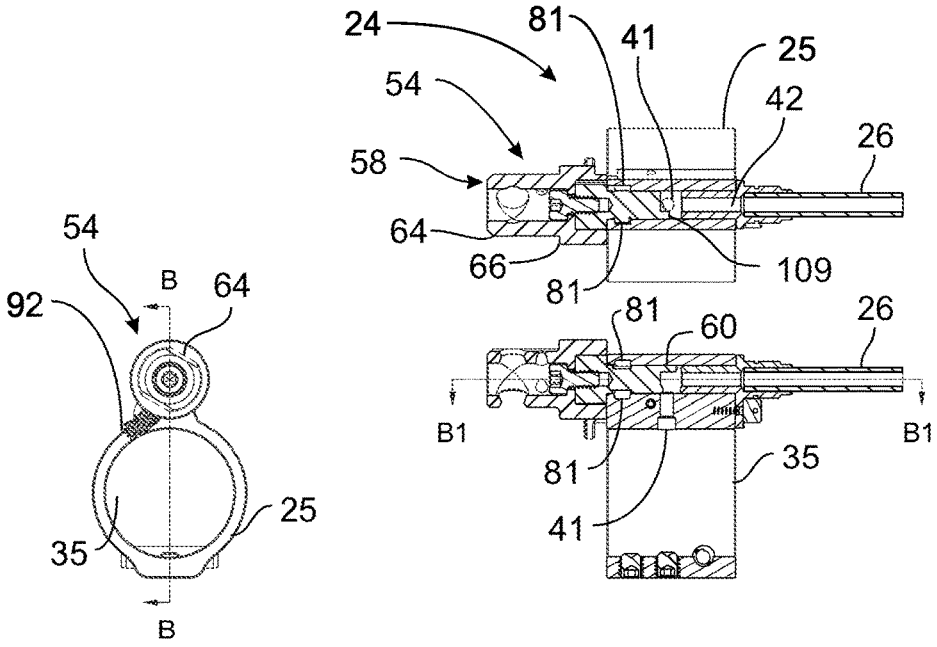
FIG. 14B

GAS TUBE ASSEMBLIES FOR GAS-ACTUATED FIREARMS

STATEMENT OF THE TECHNICAL FIELD

The inventive concepts disclosed herein relate to gas-actuated firearms in which propellant gas generated by the discharge of the firearm is used to actuate an internal mechanism that automatically reloads the firearm.

BACKGROUND

Tactical rifles and other types of firearms commonly are equipped with a gas system configured to capture energy, in the form of high-pressure gas, generated by the discharge of the firearm. The energy is used to activate and cycle a mechanism, or action, that automatically reloads the firearm. Gas-actuated firearms typically include a gas block mounted on a barrel of the firearm. The gas block has a gas port that aligns with a corresponding gas port that is formed in the barrel. The barrel gas port extends between the exterior of the barrel, and an internal bore within the barrel.

When a cartridge, i.e., a round of ammunition, is discharged within a firearm, a projectile of the cartridge is propelled through the bore by high-pressure gas generated by the ignition of propellant within the cartridge. When the propellant gas reaches the barrel gas port, a portion of the propellant gas enters that port. The propellant gas subsequently enters the gas block by way of the gas port formed therein. The propellant gas flows from the gas block gas port and into an internal passage, or gas tube receiving passage, formed within the gas block. The pressurized propellant gas then travels to the action of the firearm by way of a gas tube and a gas key that together form a continuous gas path between the gas block and the action. The action is energized by the propellant gas, and is configured to eject from the firearm the now-empty case of the fired cartridge; strip an unfired cartridge from a magazine of the firearm; and load the unfired cartridge into a chamber of the barrel.

A forward end of the gas tube is located within the gas tube receiving passage of the gas block. A rearward end of the gas tube positioned within a passage formed in the gas key. The gas tube usually is restrained from linear and rotational movement in relation to the gas block and the gas key by a pin that extends through the gas block and the forward portion of the gas tube. The pin is accommodated by a pair of diametrically-opposed holes formed in the gas block, on opposite sides of the gas tube receiving passage; and by a pair of diametrically-opposed holes formed in the gas tube. The gas tube is mated with the gas block by inserting the forward end of the gas tube into the gas tube receiving passage, aligning the through holes in the gas block with those in the gas tube, and inserting the pin through the aligned holes.

The pin usually is retained by an interference fit between the pin and the gas block. A typical pin is relatively small, e.g., about 5/64 inch in diameter and about 9/32 inch long. Therefore, installing the pin can be difficult and time consuming, and normally requires the use of a punch or other specialized tooling. For example, in addition to the difficulties stemming from working with a small work piece, it can be challenging to position the pin at the proper depth within its mounting holes in the gas block. Also, the interference fit between the pin and the gas block can make removal of the pin difficult. Because the gas tube may need to be removed and reinstalled, for example, when the firearm is undergoing maintenance or repair, or is being broken down for transport or storage, the removal and reinstallation of the gas tube can be a significant impediment to such activities over the life of the firearm.

SUMMARY

The present disclosure generally relates to gas block assemblies for firearms.

In one aspect, the disclosed technology relates to systems for directing propellant gases between a barrel and an action of a firearm. The barrel defines a bore configured to receive and guide a projectile as the projectile is propelled through the bore by a propellant gas, and a first gas port extending between the bore and an exterior surface of the barrel.

The systems include a gas block configured for mounting on the barrel. The gas block defines a first passage configured to receive the barrel, a second passage, and a second gas port that adjoins the second passage. The gas block is configured so that the second gas port is in fluid communication with the first gas port when the gas block is mounted on the barrel.

The systems also include a gas tube assembly having a gas tube that defines a passage extending between a forward and a rearward end of the gas tube. The passage in the gas tube is in fluid communication with the second passage in the gas block. The gas tube assembly also includes a mating portion that is mounted on the gas tube. The mating portion has a flange secured to the gas block.

In another aspect, the disclosed technology relates to gas tube assemblies configured to be mounted on a gas block of a gas-actuated firearm, where the gas block has an internal passage configured to receive propellant gas from a barrel of the firearm. The gas tube assemblies include a gas tube that defines a passage extending between a forward and a rearward end of the gas tube, and a mating portion secured to the gas tube. The mating portion has a flange configured to be secured to the gas block.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

Embodiments will be described with reference to the following drawing figures, in which like reference numerals represent like parts and assemblies throughout the several views.

FIG. 14A includes a front view, and cross-sectional views taken through lines "A" and "A1," of the gas block assembly shown in FIGS. 4-13, with the flow restrictor device in its unsuppressed position.

FIG. 14B includes a front view, and cross-sectional views taken through lines "B" and "B1," of the gas block assembly shown in FIGS. 4-14A, with the flow restrictor device in its suppressed position, and with an indexing portion of the flow restrictor device in a first indexed position in relation to a housing of the flow restrictor device.

DETAILED DESCRIPTION

The inventive concepts are described with reference to the attached figures. The figures are not drawn to scale and are provided merely to illustrate the instant inventive concepts. The figures do not limit the scope of the present disclosure. Several aspects of the inventive concepts are described below with reference to example applications for illustration. It should be understood that numerous specific details, relationships, and methods are set forth to provide a full understanding of the inventive concepts. One having ordinary skill in the relevant art, however, will readily recognize that the inventive concepts can be practiced without one or more of the specific details or with other methods. In other instances, well-known structures or operation are not shown in detail to avoid obscuring the inventive concepts.

Figure 1:
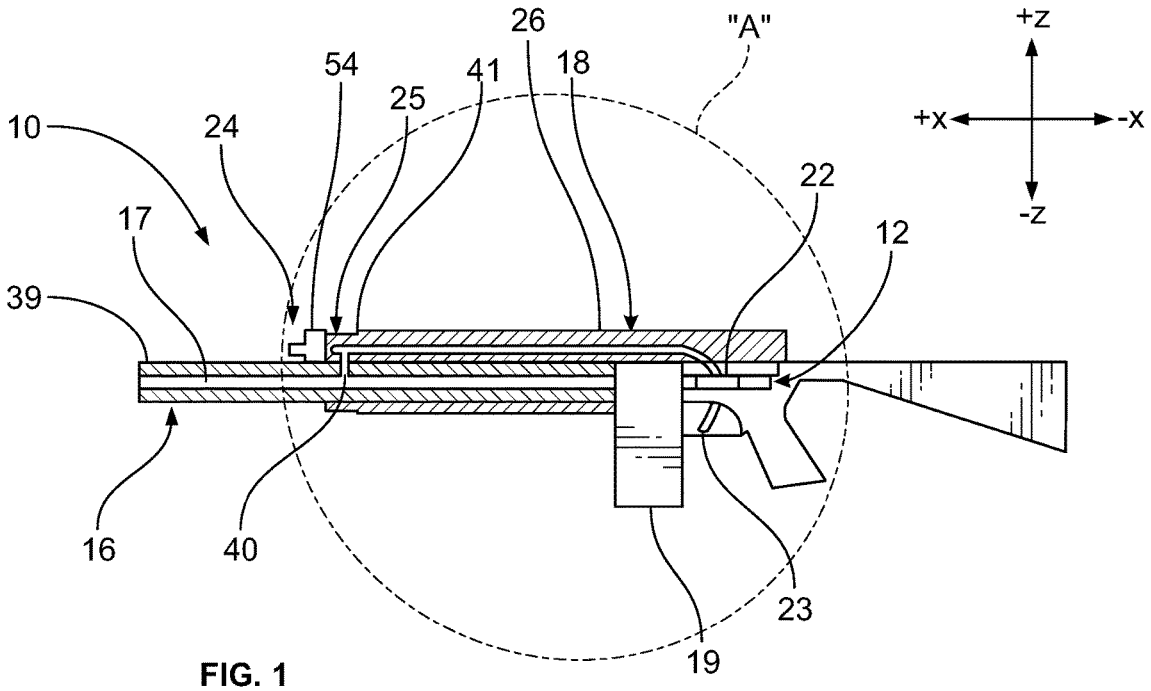
FIG. 1 is a cross-sectional side view of an exemplary firearm equipped with a gas block assembly and a gas tube assembly as described below.
Figure 2:
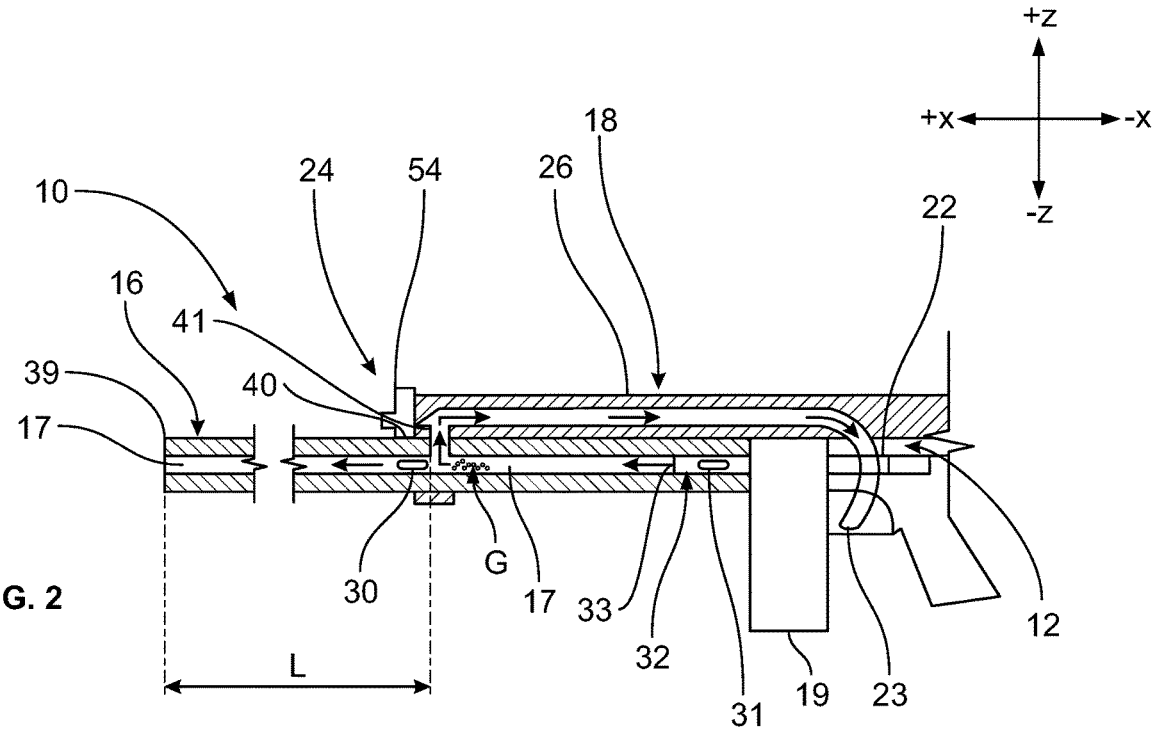
FIG. 2 is a magnified view of the area designated "A" in FIG. 1.

FIGS. 1 and 2 depict a gas-operated firearm 10. The firearm 10 is a semi-automatic rifle that fires one or more projectiles 30 in the form of bullets. The firearm 10 is a gas-operated firearm 10 equipped with a gas system 18 configured to capture energy generated by the firing of the projectiles 30, and to use the captured energy to cycle a mechanism that automatically reloads the firearm 10. Specific details of the firearm 10 are presented for exemplary purposes only. The inventive principles disclosed herein can be applied to other types of firearms, including but not limited to other types of rifles, including automatic rifles; shotguns; and pistols.

The firearm 10 comprises a receiver 12, a barrel 16, and a magazine 19 that holds unfired rounds of ammunition, or cartridges 32. The cartridges 32 each include a case 31. Each cartridge 32 also includes a projectile 30, a primer (not shown), and a propellant (also not shown) all housed within the case 31. The barrel 16 includes a chamber 33 that receives and houses an individual cartridge 32 immediately prior to firing, as shown in FIG. 2.

The receiver 12 comprises a trigger mechanism and an action 22. The trigger mechanism includes a trigger 23 that is pulled by the user, or shooter, in order to initiate the firing sequence of the firearm 10. Prior to firing, the trigger mechanism holds a hammer (not shown) in a cocked position. The trigger mechanism prevents the hammer from moving until the trigger 23 is pulled, and releases the hammer when the trigger 23 is pulled. Upon release, the hammer strikes a firing end of the cartridge 32, causing the primer within the cartridge 32 to ignite the propellant. Once ignited, the propellant forms a high-pressure propellant gas G that propels the projectile 30 through a lengthwise bore 17 formed in the barrel 16, until the projectile 30 exits the end, or muzzle 39 of the barrel 16 at high velocity.

The action 22 ejects the spent case 31 from the firearm 10 after firing, and reloads an unfired, or pre-firing, cartridge 32 into the chamber 33 from the magazine 19. The action 22 is gas-actuated, i.e., the action 22 receives energy from the gas system 18 in the form of the high-pressure propellant gas G generated by the burning propellant of the cartridges 32, and uses that energy to eject the spent case 31 and to reload an unfired cartridge 32.

The gas system 18 is a direct-impingement gas system in which the propellant gas G acts directly on the action 22;

other types of gas systems, such as gas piston systems, can be used in the alternative. The action 22 is a bolt carrier group; other types of actions can be used in the alternative.

Figure 3:
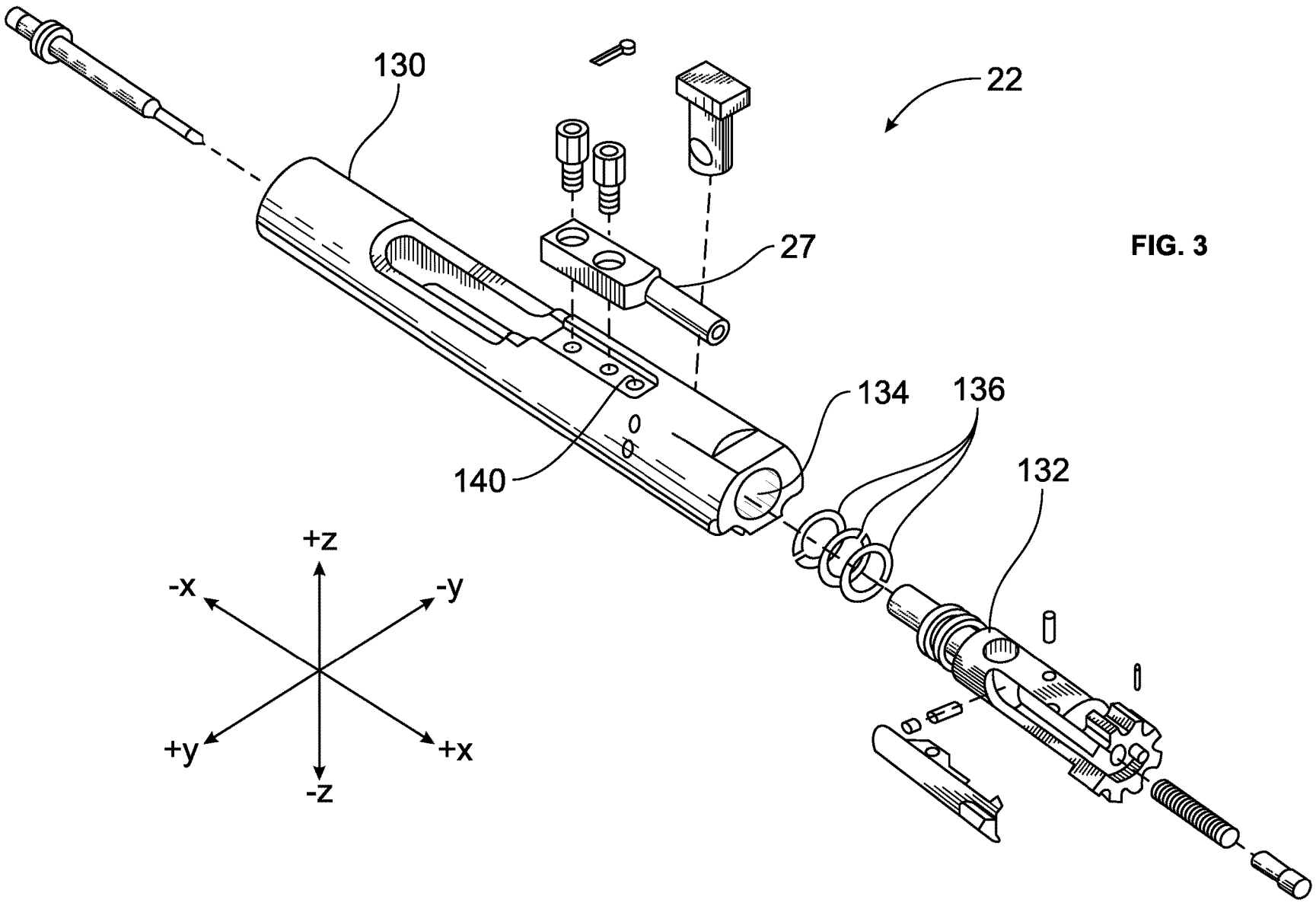
FIG. 3 is a partially exploded view of an action of the firearm shown in FIGS. 1 and 2.

The action 22 is shown in detail in FIG. 3. The action 22 includes a bolt carrier 130 and a bolt member 132. The bolt carrier 130 defines a bolt chamber 134. A rearward portion of the bolt member 132 is positioned within the bolt chamber 134, and can move both linearly and rotationally within the bolt chamber 134. The bolt member 132 has gas seal rings 136 that form a movable seal between the bolt member 132 and the adjacent surface of the bolt carrier 130 within the bolt chamber 134. A volume between an internal wall of the bolt carrier and the rear portion of the bolt member 132 forms a gas actuation chamber that receives the propellant gas G.

The bolt carrier 130 moves rearwardly, in a linear ("−x") direction, within the receiver 12 in response to the pressure exerted by the propellant gas G within the gas actuation chamber. In addition, the bolt member 132 is driven forwardly within the bolt chamber 134 by the pressure of the propellant gas G acting on the surface of the bolt carrier 132 and on the gas seal rings 136 of the bolt member 132. The bolt carrier 130 compresses a recoil spring (not shown) as the bolt carrier 132 translates rearwardly. The recoil spring drives the bolt carrier 130 and the bolt member 132 forwardly when the pressure exerted by the propellant gas G has decreased sufficiently so as to be overcome by the force of the recoil spring.

As the bolt carrier 130 is initially retracted rearward under the pressure of the propellant gas G, the bolt member 132 is rotated sufficiently to unlock its head portion from a locking receptacle (not shown). The bolt member 132 then retracts along with the bolt carrier 130. As the bolt member 132 is retracted, it extracts a spent cartridge case 31 from the chamber 33 of the barrel 16, and ejects the spent case 31 through a cartridge port, or breech (not shown), formed in the receiver 12. As the bolt carrier 130 and bolt member 132 subsequently are driven forward by the force of the recoil spring, the head portion of the bolt member strips an unfired cartridge 32 from the magazine 19, and feeds the cartridge 32 into the chamber 33 of the barrel 16 in preparation for subsequent firing.

Referring to FIGS. 3-10, the gas system 18 includes a gas block assembly 24, a gas tube assembly 26, and a gas key 27. The gas block assembly 24 comprises a gas block 25 that receives propellant gas G from the barrel 16. The gas block 25 directs the propellant gas G to the gas tube assembly 26, which in turn directs the high-pressure gas to the gas key 27. The gas key 27 is in fluid communication with a gas port 140 of the action 22.

The barrel 16 has a gas port 40 formed therein. The barrel gas port 40 extends through a wall of the barrel 16, as can be seen in FIGS. 1 and 2. The barrel gas port 40 is located forward of the chamber 33, i.e., to the left of the chamber 33 from the perspective of FIGS. 1 and 2, at a predetermined distance L from the muzzle 39 of the barrel 16. The barrel gas port 40 forms a passageway that extends in a direction substantially perpendicular to the lengthwise direction of the bore 17. The barrel gas port 40 can have other orientations in alternative embodiments.

The gas block 25 includes a cylindrical barrel receiving passage 35 that receives the barrel 30, as shown for example in FIGS. 4, 5, 8, and 9. The gas block 25 can be secured to the barrel 25 by two set screws 36, shown in FIG. 9. One, or both of the set screws 36 can engage a corresponding dimple (not shown) formed in the barrel 16, to properly position the gas block 25 on the barrel 16.

The gas block 25 also has a gas port 41, and a gas tube receiving passage 42 formed therein. The gas block gas port 41 is visible in FIGS. 1, 2, 9, and 10. The gas tube receiving passage 42 is visible in FIGS. 4, 5, 9, and 10. The gas block gas port 41 adjoins the gas tube receiving passage 42, and forms part of a flow path between the bore 17 of the barrel 16, and the gas tube receiving passage 42. The gas block gas port 41 extends in a direction substantially perpendicular to the lengthwise, or "x" direction of the barrel receiving passage 35, i.e., the gas block gas port 41 extends substantially in the "z" direction. The gas block gas port 41 can have other orientations in alternative embodiments.

The barrel gas port 40 is aligned with the gas block gas port 41 as shown in FIGS. 1 and 2, so that a portion of the propellant gas Gin the bore 17 can enter the gas tube receiving passage 42 by way of the barrel gas port 40 and the gas block gas port 41. The diameter of the barrel receiving passage 35 is selected so that minimal clearance exists between the outer surface of the barrel 16 and the adjacent surface of the gas block 25, to discourage leakage of the propellant gas G as it flows between the barrel gas port 40 and the gas block gas port 41.

Figures 4, 5:
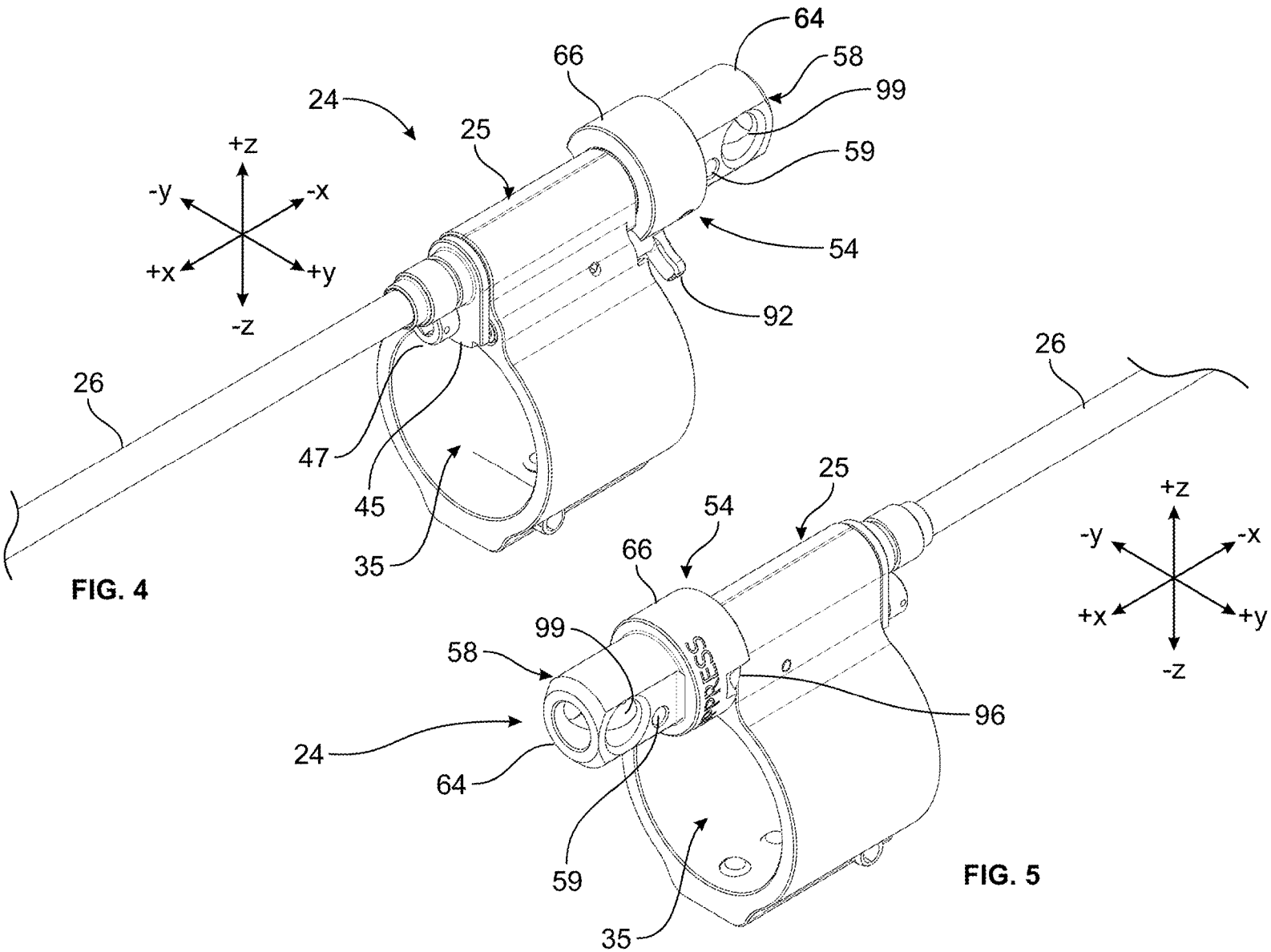
FIG. 4 is a top-rear perspective view of the gas block assembly of the firearm shown in FIGS. 1 and 2, with a flow restrictor device of the assembly in its unsuppressed position.
FIG. 5 is a top-front perspective view of the gas block assembly shown in FIG. 4, with the flow restrictor device in its unsuppressed position.

The gas tube receiving passage 42 is substantially cylindrical, and extends in a direction substantially parallel to the lengthwise direction of the barrel receiving passage 35, i.e., the gas tube receiving passage 42 extends substantially in the "x" direction. The gas tube receiving passage 42 can have other orientations in alternative embodiments. A forward end of the gas tube receiving passage 42 is defined by a forward aperture 43 formed in a forward surface 51 of the gas block 25, as shown in FIG. 5. A rearward end of the gas tube receiving passage 42 is defined by a rearward aperture 44 formed in a rearward surface 52 of the gas block 25, as shown in FIG. 4.

The propellant gas G generated by the burning propellant of the cartridge 32 travels behind, and propels the projectile 30 through the bore 17 of the barrel 16, as indicated by the arrows in FIG. 2. As the propellant gas G reaches the barrel gas port 40, a portion of the propellant gas G enters, and travels through the barrel gas port 40. The propellant gas G then enters the gas block gas port 41, which directs the propellant gas G to the gas tube receiving passage 42. The propellant gas G reaches the gas tube assembly 26 by way of the gas tube receiving passage 42, and then travels through the gas tube assembly 26 and towards the actuator 22. The propellant gas G subsequently is released into the gas actuation chamber of the action 22 by way of the gas key 27 and the gas port 140. The barrel gas port 40, gas block gas port 41, gas tube receiving passage 42, gas tube assembly 26, and gas key 27 thus form a continuous flow path between the bore 17 of the barrel 16, and the action 22. Also, the gas block 25 and the gas tube assembly 26 constitute a system for directing propellant gases between the barrel 16 and the action 22.

The gas block assembly 24 also comprises a flow restrictor device 54 that is configured to allow the user to adjust of the volume and pressure of the propellant gas G that reaches the action 22. Details of the flow restrictor device 54 follow. The use of the gas tube assembly 26 in a firearm 10 equipped with the flow restrictor device 54 is described for exemplary purposes only. The gas tube assembly 26 can be used in firearms that are not equipped with the flow restrictor device 54.

Features of the Flow Restrictor Device that Facilitate Restricted and Unrestricted Propellant Gas Flow The flow restrictor device 54 can be used to adjust the volume and pressure of the propellant gas G that reaches the action 22, for example, when the firearm 10 is used with a suppressor. Because the suppressor restricts the flow of the propellant gas G exiting the barrel 17, the presence of the suppressor causes the pressure of the propellant gas G in the barrel 17 to be higher than it otherwise would be, which in turn results in a higher pressure and flow rate of the propellant gas G reaching the action 22 by way of the gas system 18. The increased pressure and flow rate can exceed the pressure and flow rate at which the action 22 is designed to operate, increasing the potential for premature wear and damage to the action 22, and jamming of the firearm 10. The flow restrictor device 54 permits the user to restrict the flow of propellant gas G reaching the action 22 by way of the gas system 18, thereby allowing the action 22 to function within, or close to its design parameters when the firearm 10 is used with a suppressor. This feature also can be used, for example, when the firearm 10 is used with a type of cartridge 32 that generates propellant gas G at a relatively high pressure.

The flow restrictor device 54 comprises a flow restrictor 56 and a flow restrictor housing 58. The flow restrictor device 54 is mounted for rotation on the gas block 25. The flow restrictor 56 comprises a first, or restricting portion 60; a second, or retaining portion 62 that adjoins a forward end of the first portion 60; and a third, or indexing portion 63 that adjoins a forward end of the retaining portion 62. The flow restrictor housing 58 has a forward, or first portion 64; and a rearward, or second portion 66.

Figure 10:
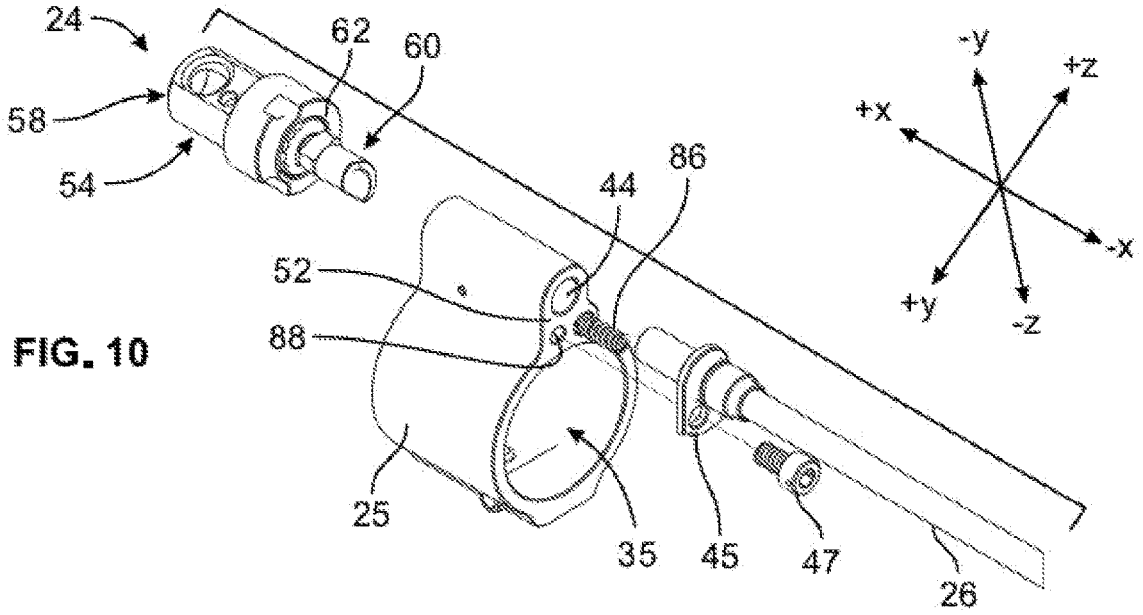
FIG. 10 is a partially exploded rear perspective view of the gas block assembly shown in FIGS. 4-9.
Figure 11:
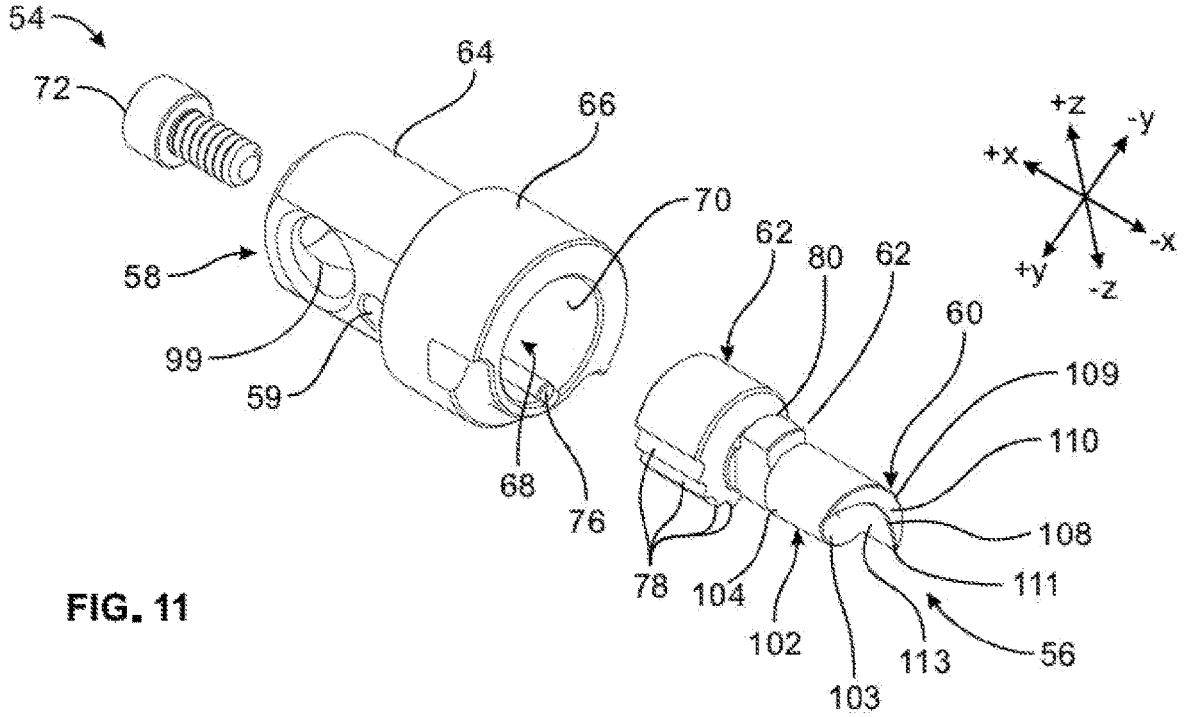
FIG. 11 is a rear perspective exploded view of the flow restrictor device of the gas block assembly shown in FIGS. 4-10.

The indexing portion 63 of the flow restrictor 54 is positioned within a cylindrical cavity 68 formed in the second portion 66 of the flow restrictor housing 58, as can be seen in FIGS. 10 and 11. The cavity 68 is defined by an interior wall surface 70 of the second portion 66. The flow restrictor 56 is secured to the flow restrictor housing 58 by a screw 72 that extends through the first portion 64 of the flow restrictor housing 58 and engages internal threads formed in the indexing portion 63 of the flow restrictor 56. The flow restrictor housing 58 has holes 59 formed therein to accommodate an optional roll pin (not shown) or other mechanical means for rotating the flow restrictor device 54.

Figure 6:
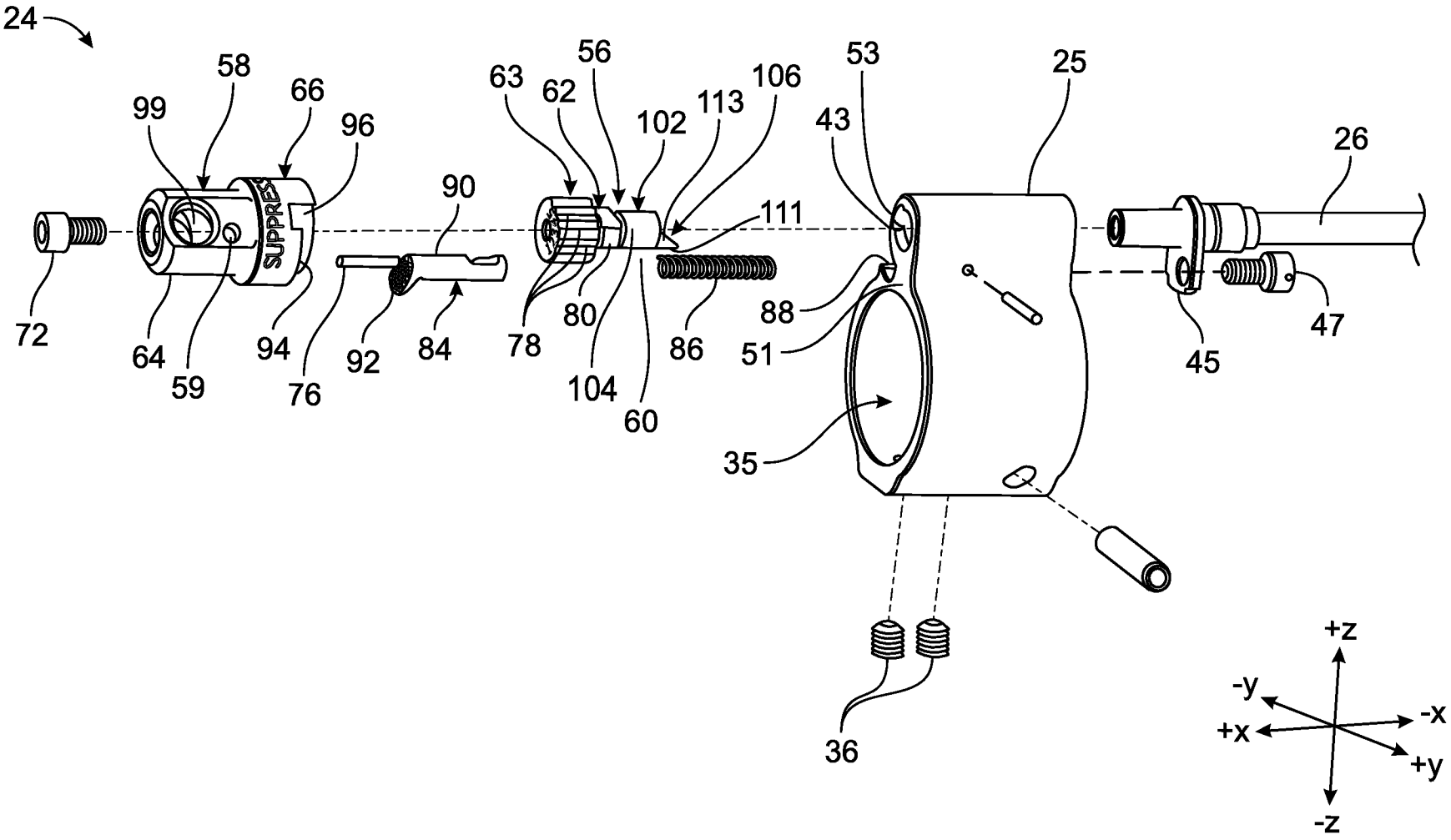
FIG. 6 is an exploded front perspective view of the gas block assembly shown in FIGS. 4 and 5.
Figure 7:
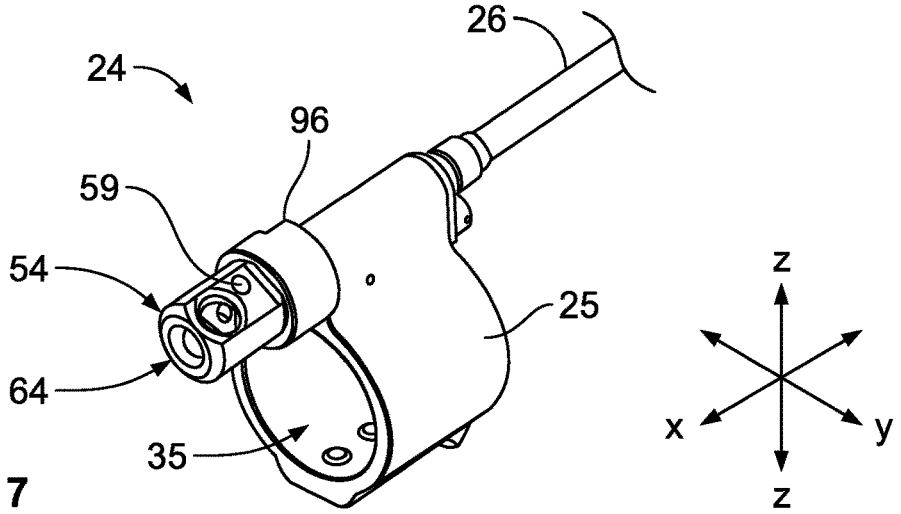
FIG. 7 is a top-front perspective view of the gas block assembly shown in FIGS. 4-6, with the flow restrictor device in its suppressed position.
Figure 8:
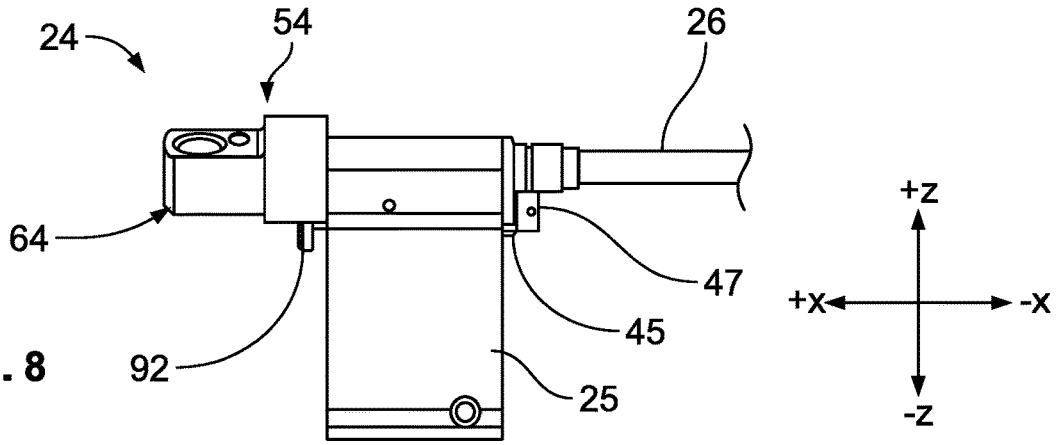
FIG. 8 is a side view of the gas block assembly shown in FIGS. 4-7, with the flow restrictor device in its suppressed position.
Figure 9:
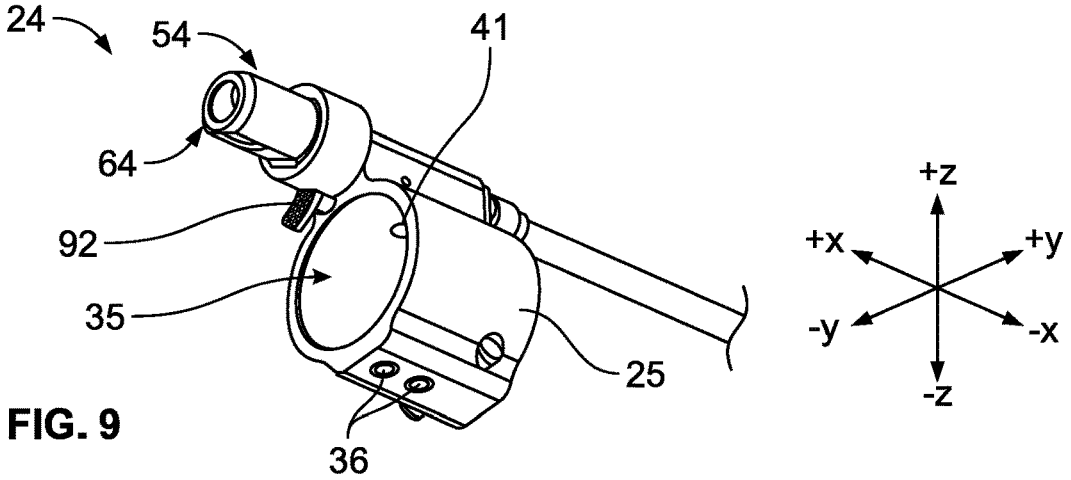
FIG. 9 is a bottom-front perspective view of the gas block assembly shown in FIGS. 4-8, with the flow restrictor device in its suppressed position.
Figure 12:
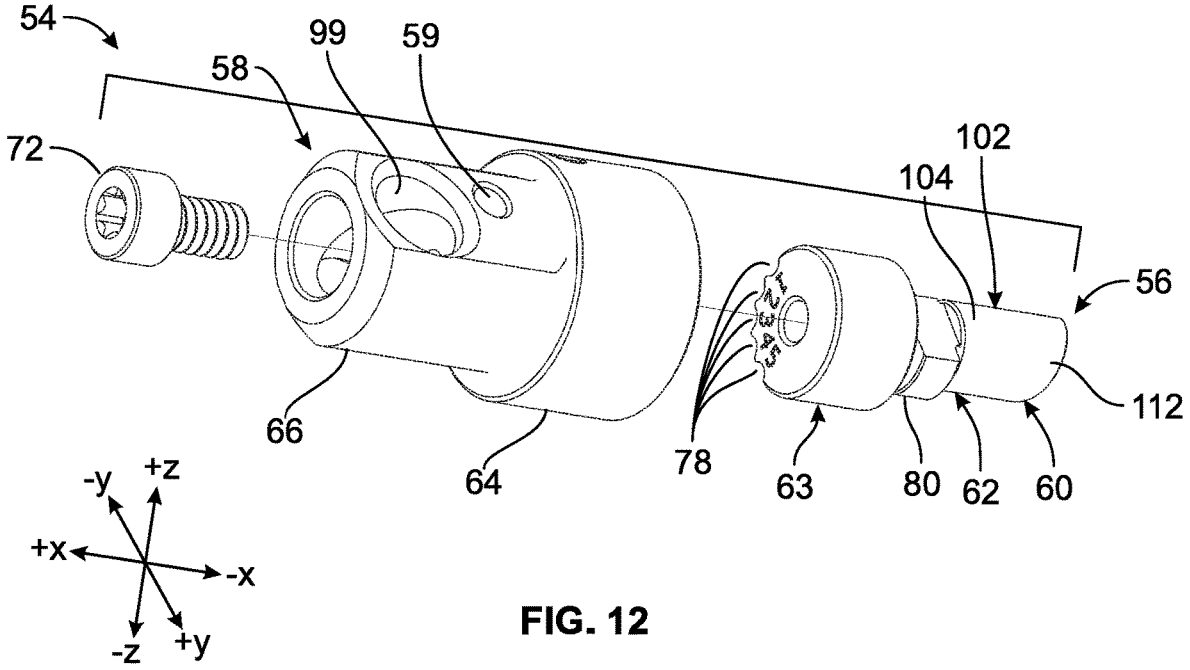
FIG. 12 is a front perspective exploded view of the flow restrictor device shown in FIG. 11.
Figure 13:
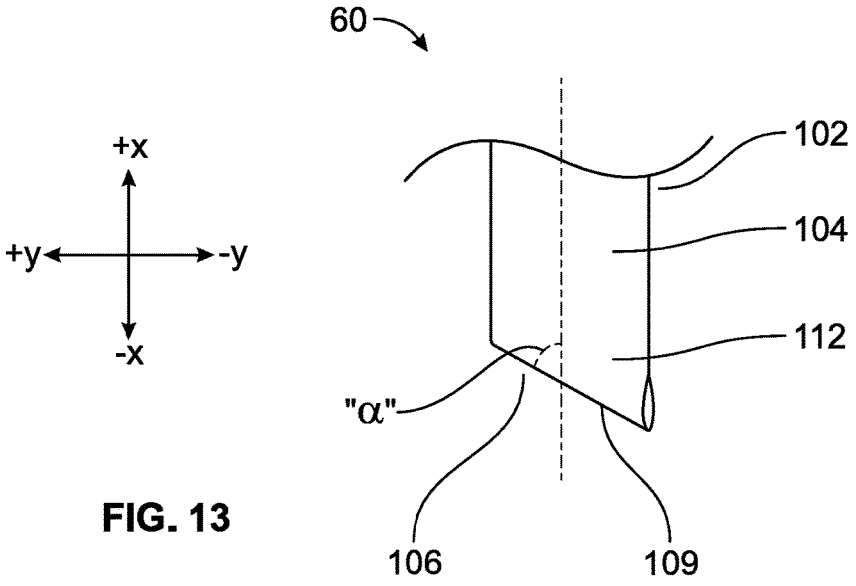
FIG. 13 is a top view of a restricting portion of the flow restrictor device shown in FIGS. 11 and 12.

The flow restrictor housing 58 includes an indexing key in the form of an indexing pin 76. The indexing pin 76 is disposed in a groove formed in the wall surface 70 of the flow restrictor housing 58, and extends in the lengthwise, or "x" direction of the flow restrictor housing 58, as shown in FIG. 11. The indexing portion 63 of the flow restrictor 56 has five notches or grooves 78 formed therein and extending in the lengthwise direction of the flow restrictor 56, as can be seen in FIGS. 6, 11, and 12. Each groove 78 is configured to receive the indexing pin 76 of the flow restrictor housing 58 when the flow restrictor 56 is at a particular angular, or clock position in relation to the flow restrictor housing 58.

The grooves 78 and the indexing pin 76, along with the screw 72, cause the flow restrictor 56 to rotate with the flow restrictor housing 58. In addition, the grooves 78 and the indexing pin 76 permit the flow restrictor 56 to be indexed in five different angular positions in relation to the flow restrictor housing 58. The significance of this feature is discussed below.

The grooves 78 can be formed in the flow restrictor housing 58, and the indexing pin 76 can be positioned on the flow restrictor 56 in alternative embodiments. Also, other types of indexing keys, such as a tab, can be used in lieu of the indexing pin 76. Moreover, alternative embodiments can include less, or more than five grooves 78 (e.g., 2, 3, 4, 6, 7, 8, or 9 grooves), depending on the desired degree of adjustability in the position of the flow restrictor 56 in relation to the flow restrictor housing 58.

The flow restrictor device 54 is mounted for rotation on the gas block 25. The first, or restricting portion 60, and the second, or retaining portion 62 of the flow restrictor 56 are located within the gas tube receiving passage 42 when the flow restrictor device 54 is mounted on the gas block 25. The flow restrictor device 54 is retained on the gas block 25 by interference between the retaining portion 62 and the gas block 25. In particular, the retaining portion 62 has a keyed area 80 that locally increases the diameter of the retaining portion 62, as can be seen in FIGS. 6, 11, and 12. The forward aperture 43, and the adjoining portion of the gas tube receiving passage 42 in the gas block 25, have a shape that matches that of the retaining portion 62. In particular, the forward aperture 43 has a notched area 53, as noted above; and the notched area 53 extends slightly into the gas tube receiving passage 42. The notched area 53 locally increases the diameters of the forward aperture 43 and the gas tube receiving passage 42, as shown in FIG. 6.

The retaining portion 62 of the flow restrictor 56 can only pass through the aperture 43 and the forward portion of the gas tube receiving passage 42 when the keyed area 80 of the retaining portion 62 is aligned with the notched area 53. The flow restrictor device 54 is installed on the gas block 25 by aligning the keyed area 80 on the retaining portion 62 with the notched area 53. The restricting portion 60 and the retaining portion 62 are then inserted through the forward aperture 53 and into the gas tube receiving passage 42, until the indexing portion 63 of the flow restrictor 56, which has a larger overall diameter than the aperture 53, abuts the forward surface 51 of the gas block 25.

At this point, the retaining portion 62 aligns with a groove 81 within the gas tube receiving passage 42. The groove is visible in FIGS. 14A-14F. The groove 81 is configured to receive the keyed area 80 on the retaining portion 62. The flow restrictor 56 can be rotated as this point so that the keyed area 80 enters the groove 81. Interference between the forward surface of the groove 81 and the keyed area 80 will prevent the retaining portion 62 from backing out of the gas tube receiving passage 42 while the keyed area 80 and the notched area 53 remained misaligned, thereby causing the flow restrictor 56 to be retained on the flow restrictor housing 58.

The flow restrictor device 54 also comprises a plunger, or stop 84, and a biasing means (e.g., spring 86), as shown in FIG. 6. The spring 86 is located in a spring passage 88 that extends between the forward surface 51 and the rearward surface 52 of the gas block 25. The rearward end of the spring passage 88 is covered by a flange 210 of the gas tube assembly 26 as depicted in FIG. 4, so that the flange 210 retains the spring 86.

The stop 84 includes an elongated portion 90, and a tab 92. The elongated portion 90 is positioned within the spring passage 88, and compresses the spring 86 so that the spring 86 exerts a spring force, or bias, on the stop 84 in the forward direction. The tab 92 abuts the rearward portion 66 of the flow restrictor housing 58; the flow restrictor housing 58 thereby retains the stop 84 in the spring passage 88.

The rearward portion 66 of the flow restrictor housing 58 has a recess 94 formed therein and extending along a portion of the outer periphery of the rearward portion 66. Two detents 96 are also formed in the rearward portion 66, at opposite ends of the recess 94, as can be seen in FIGS. 5, 6, and 11.

The recess 94 and the detents 96 accommodate the stop 84. The stop 84, in conjunction with the detents 96, limit the rotational movement of the flow restrictor device 54 between a first, or unsuppressed portion; and a second, or suppressed position. When the flow restrictor device 54 is located in the suppressed position, as shown for example in FIGS. 7-9, the flow restrictor 56 partially blocks the gas block gas port 41. This feature can be used, for example, to compensate for the increased pressure of the propellant gas G within the barrel 16 when the firearm 10 is fired with a suppressor installed. When the flow restrictor device 54 is located in the unsuppressed position, as shown for example in FIGS. 4 and 5, the flow restrictor 56 does not block the gas block gas port 41, allowing the propellant gas G to pass through the gas block gas port 41 and into a gas tube 204 of the gas tube assembly 26 in an unrestricted manner.

A first of the detents 96 aligns with the tab 92 of the stop 84 when the flow restrictor device 54 is in the suppressed position. The other, or second detent 96 aligns with the tab 92 when the flow restrictor device 54 is in the unsuppressed position. The forward bias of the spring 86 urges a portion of the tab 92 into the first or second detent 96 when the tab 92 is aligned with that particular detent 96. Interference between the tab 92, which his mounted on the gas block 25, and the adjacent surfaces of the flow restrictor housing 58 inhibits rotation of the flow restrictor device 54 in relation to the gas block 25 when the tab 92 is positioned within either of the detents 96. This can be seen, for example, in FIG. 8, which depicts the tab 92 biased into its forward position within one of the detents 96. The tab 92 will remain in the detent 96 until the user pushes, or depresses the tab 92 rearward, against the bias of the spring 86.

When the tab 92 is fully depressed in the detent 96, the flow restrictor device 54 can be rotated in a direction that moves the other, unoccupied detent 96 toward the tab 92. The recess 94 in the flow restrictor housing 58 accommodates the tab 92, in its depressed state, as the flow restrictor device 54 is rotated, so that the depressed tab 92 does not interfere with the rotation of the flow restrictor device 54. The tab 92 will align with the previously unoccupied detent 96 as the flow restrictor device 54 reaches its suppressed or unsuppressed position, depending on the direction in which the flow restrictor device 54 is being rotated. The tab 92, upon aligning with the detent 96, is urged forwardly, into the detent 96, under the bias of the spring 86. The tab 92 will retain the detent 96, and the flow restrictor device 54 will remain in its suppressed or unsuppressed position, until the tab 92 is once again depressed by the user.

The first, or forward portion of the flow restrictor housing 58 can be used as a knob to facilitate manual rotation the flow restrictor device 54. Also, as discussed above, a roll pin or other mechanical means can be used to rotate the flow restrictor device 54, if desired.

Details of the stop 84, the recess 94, and the detents 96 are provided for exemplary purposes only. Other means for retaining the flow restrictor device 54 in the suppressed and unsuppressed positions can be used in the alternative.

The first, or restricting portion 60 of the flow restrictor 56 restricts the flow of propellant gas G through the gas block gas port 41 when the flow restrictor device 54 is in its suppressed position. Referring to FIGS. 6 and 11-13, the restricting portion 60 comprises a substantially cylindrical body 102 that adjoins the retaining portion 62 of the flow restrictor 56. The body 102 has a substantially planar rearward surface 103. The rearward surface 103 is oriented substantially in the lateral or "y" direction. The body 102 also has an outer surface 104.

The restricting portion 60 also comprises a tail portion 106 that adjoins the body 102. The tail portion 106 has a relatively thin and wide, i.e., blade-like, overall profile. The tail portion 106 has an inner edge 108, an outer edge 109, and a rearward surface 110. The rearward surface 110 is positioned between, and is defined by the inner edge 108 and the outer edge 109. A first end of the outer edge 109 adjoins a first end of the inner edge 108; a second end of the outer edge 109 adjoins a second end of the inner edge 108. These features, in conjunction with the curvilinear shape of the inner edge 108 and outer edge 109, give the rearward surface 110 a shape approximating that of a crescent. The tail portion 106 also includes a third edge 111 that extends substantially in the lengthwise or "x" direction, and adjoins the rearward surface 103 of the body 102.

The tail portion 106 further comprises an outer surface 112 that adjoins the outer surface 104 of the body 102, and is defined in part by the outer edge 109 and the third edge 111. The outer surface 112 and the outer surface 104 both have a curvature that substantially matches that of the adjacent surface of the gas tube receiving passage 42. The body 102 and the tail portion 106 are configured so that minimal clearance exists between the outer surfaces 112, 104 and the adjacent surface of the gas tube receiving passage 42.

The tail portion 106 also comprises an inner surface 113. The inner surface 113 adjoins the rearward surface 103 of the body 102, and is defined part by the inner edge 108 and the third edge 111. The inner surface 113 has a curvature that substantially matches that of the inner edge 108.

The outer edge 109 of the tail portion 106 is angled in relation to the lengthwise, or "x" direction of the flow restrictor 56. The angle between the outer edge 109 and the x direction is denoted in FIG. 13 by the symbol "a." The angle $\alpha$ is an acute angle, i.e., an angle less 90 degrees. The optimum value for the angle $\alpha$ is dependent upon factors such as the desired degree of restriction of the gas block gas port 41, and whether and to what extent the flow restrictor 56 can be indexed in different positions in relation to the flow restrictor housing 58. The angled orientation of the outer edge 109 causes the shape of the tail portion 106 to appropriate that of a helix.

The flow restrictor 56 is configured so that the outer surface 112 of the tail portion 106 partially covers, or blocks the gas block gas port 41 when the flow restrictor device 54 is in its suppressed position, thereby reducing the flow rate and pressure of the propellant gas G entering the gas tube receiving passage 42 and the gas tube assembly 26.

The flow restrictor 56 is further configured so that the tail portion 106 does not block the gas block gas port 41 when the flow restrictor device 54 is in its unsuppressed position. In particular, when the flow restrictor 56 is in its unsuppressed position, the outer surface 112 of the tail portion 106 is no longer partially aligned with the gas block gas port 41, and the flow of the propellant gas G through the gas block gas port 41 is unrestricted. This can be seen in FIG. 14A, which depicts the flow restrictor device 54 in its unsuppressed position.

Features of the Flow Restrictor Device that Facilitate Adjustment of the Propellant Gas Flow In addition, the angled orientation of the outer edge 109 of the tail portion 106, in conjunction with the indexing pin 76 of the flow restrictor housing 58 and the grooves 78 formed in the flow restrictor 56, permit the degree of blockage of the gas block gas port 41 to be varied as follows. The flow restrictor 56 can be positioned within the flow restrictor housing 58 in five different angular orientations, or clock positions, depending on which groove 78 is aligned with the indexing pin 76 as the flow restrictor 56 is inserted into the flow restrictor housing 58. When the indexing pin 76 is aligned with a first of the grooves 78 and the flow restrictor device 54 is in the suppressed position, the orientation of the flow restrictor 56 is such that the outer surface 112 of the tail portion 106 covers a relatively small percentage of the overall area of the gas block gas port 41, as shown in FIG. 14B. Thus, the flow restrictor 56 will present a minimal restriction to the flow of propellant gas G through the gas block gas port 41 under these circumstances.

Figure 14C:
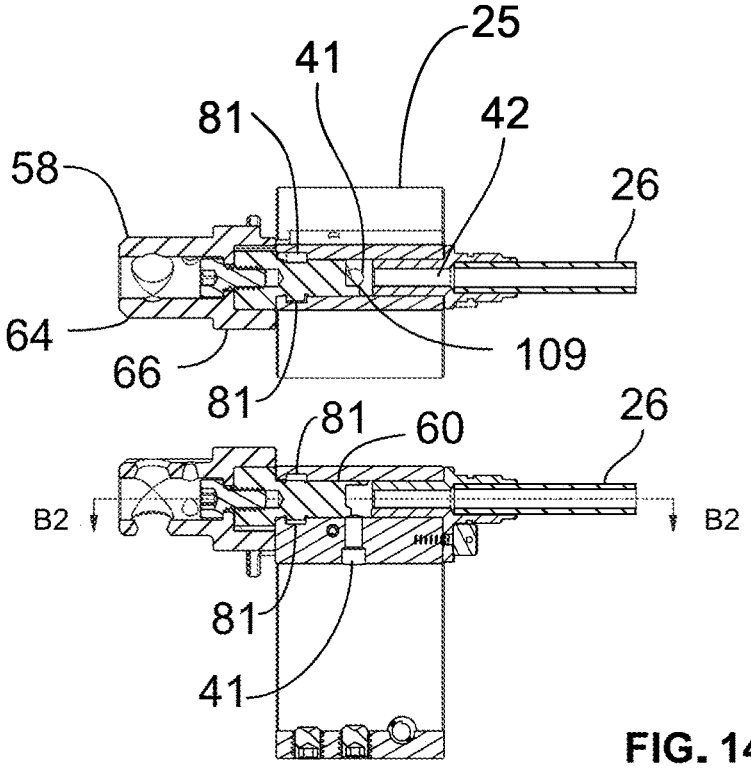
FIG. 14C includes cross-sectional views, taken through line "B" of FIG. 14B, and line "B2," of the gas block assembly shown in FIGS. 4-14B, with the flow restrictor device in its suppressed position, and with the indexing portion in a second indexed position in relation to the housing.

When the indexing pin 76 is aligned with a second of the grooves 78, instead of the first groove 78, and the flow restrictor device 54 is in the suppressed position, the resulting change in the angular position of the tail portion 106, in conjunction with the angled orientation of the outer edge 109 of the tail portion 106, causes more of the outer surface 112 of the tail portion 106 to cover the gas block gas port 41 as shown in FIG. 14C. In particular, with the indexing pin 76 aligned with the second instead of the first groove 78, the same angular displacement of the flow restrictor device 54 between the unsuppressed and suppressed positions causes a different portion of the outer surface 112 to rotate into a position over the gas block gas port 41; and due to the angled orientation of the outer edge 109 (which defines the rearward boundary of the outer surface 112), the different portion of the outer surface 112 covers more of the gas block gas port 41. Thus, the degree of restriction in the flow through the gas block gas port 41 is increased when the indexing pin 76 is aligned with the second, instead of the first groove 78.

The degree of restriction in the flow through the gas block gas port 41 can be further increased by aligning the indexing pin 76 with the third, fourth, and fifth grooves 78. As explained above, aligning the indexing pin 76 with a different groove 78 causes a different portion of the outer surface 112 of the tail portion 106 to cover the gas block gas port 41 when the flow restrictor device 54 reaches the suppressed position, and the angled orientation of the outer edge 109 of the tail portion 106 results in more, or less of the outer surface 112 being positioned over the gas block gas port 41.

Figure 14D:
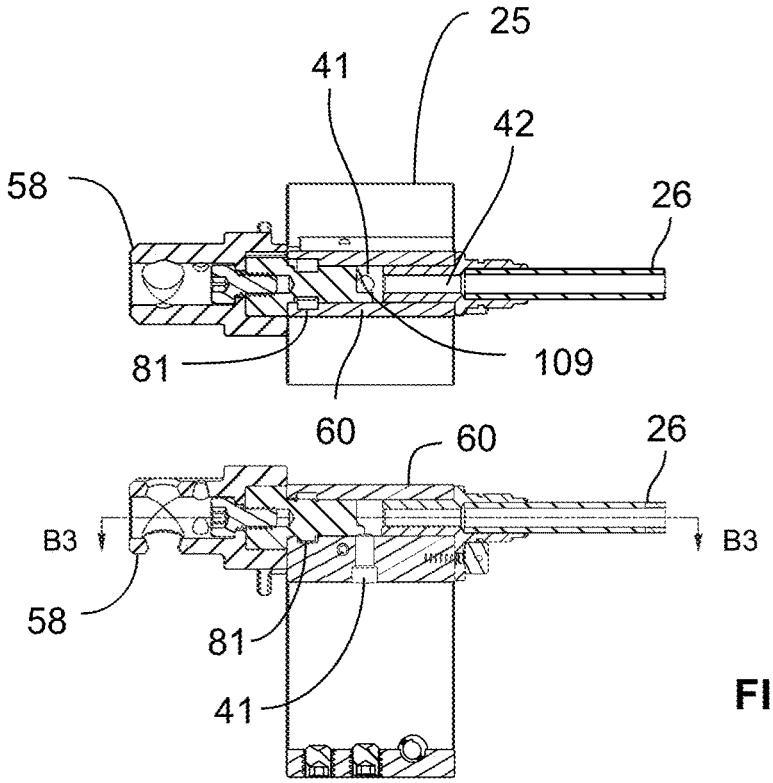
FIG. 14D includes cross-sectional views, taken through line "B" of FIG. 14B, and line "B3," of the gas block assembly shown in FIGS. 4-14C, with the flow restrictor device in its suppressed position, and with the indexing portion in a third indexed position in relation to the housing.
Figure 14E:
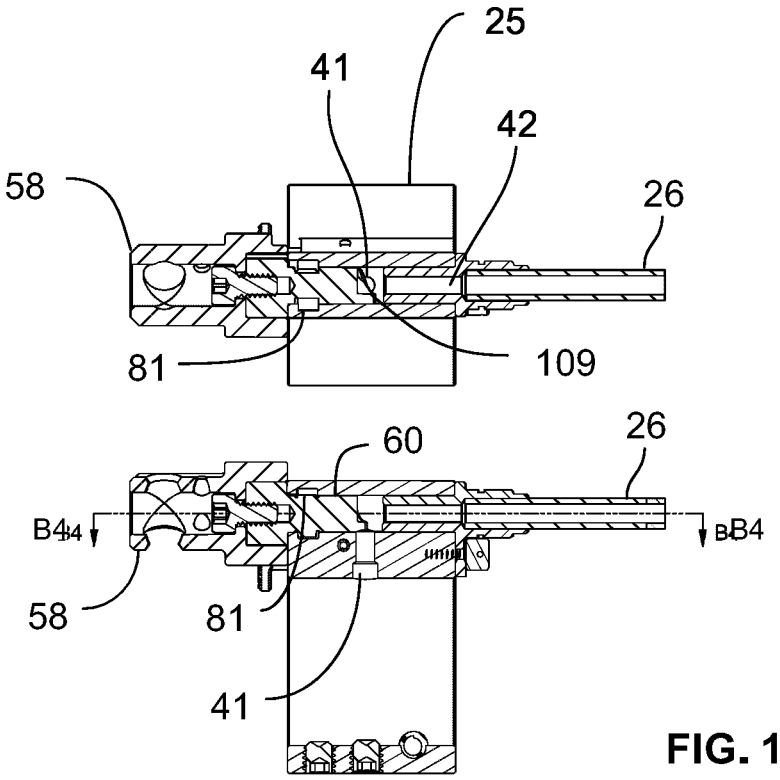
FIG. 14E includes cross-sectional views, taken through line "B" of FIG. 14B, and line "B4," of the gas block assembly shown in FIGS. 4-14C, with the flow restrictor device in its suppressed position, and with the indexing portion in a fourth indexed position in relation to the housing.
Figure 14F:
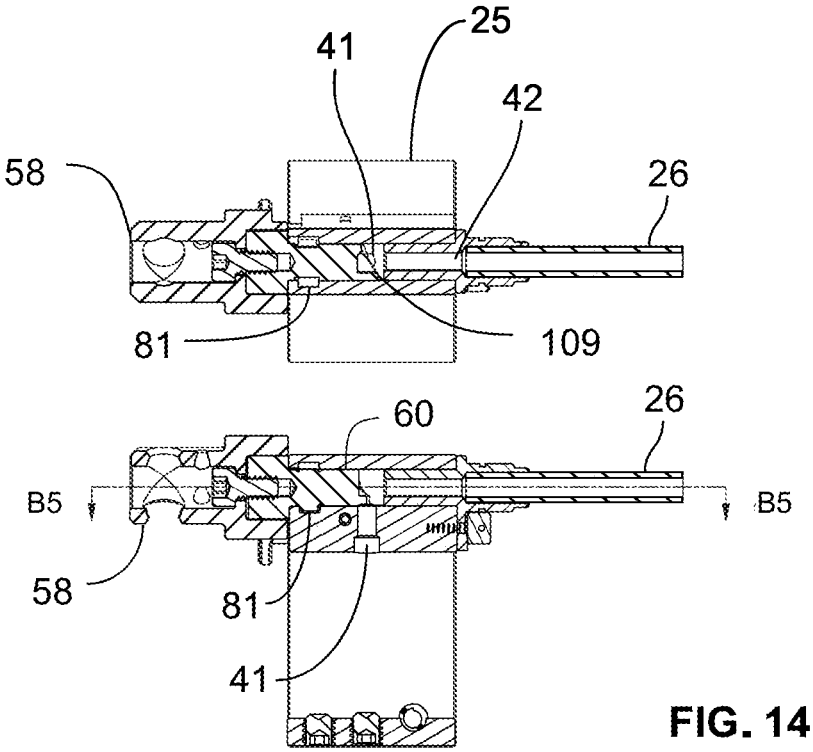
FIG. 14F includes cross-sectional views, taken through line "B" of FIG. 14B, and line "B5," of the gas block assembly shown in FIGS. 4-14D, with the flow restrictor device in its suppressed position, and with the indexing portion in a fifth indexed position in relation to the housing.

This can be seen, for example, in FIG. 14D, which depicts the flow restrictor device 54 when the indexing pin 76 is aligned with the third groove 78; in FIG. 14E, which depicts the flow restrictor device 54 when the indexing pin 76 is aligned with the fourth groove 78; and in FIG. 14F, which depict the flow restrictor device 54 when the indexing pin 76 is aligned with the fifth groove 78. As can be seen by comparing FIGS. 14B and 14C, the amount of blockage of the gas block gas port 41 increases as the indexing pin 78 is aligned with the second, as opposed to the first, groove 78. Further blockage occurs as the indexing pin 76 is aligned successively with the third, fourth, and fifth grooves 78 as shown in FIGS. 14D-14F; with maximal blockage being achieved when the indexing pin 76 is aligned with the fifth groove 78.

Thus, the flow restrictor device 54 is switchable between a suppressed and unsuppressed position. In addition, the flow restrictor device 54 is adjustable to permit variation in the degree to which the flow rate and pressure of the propellant gas G are attenuated when the flow restrictor device 54 is in the suppressed position. As noted above, when the firearm 10 is to be used without a suppressor, the flow restrictor device 54 can be placed in the unsuppressed position, so that the flow restrictor device 54 provides no restriction on the propellant gas G entering the gas tube receiving passage 42 by way of the gas block gas port 41.

When the firearm 10 is to be used with a suppressor, the user merely needs rotate the flow restrictor device 54 to the suppressed position. The resulting reduction in the flow rate and pressure of the propellant gas G entering the gas tube receiving passage 42 compensates for the increased gas pressure within the barrel 16 resulting from the backpressure introduced by the suppressor. By attenuating the flow rate and pressure of the propellant gas G reaching the action 22, the flow restrictor device 54 can prevent premature wear and damage to the action 22, and jamming of the firearm 10, that otherwise could occur due to exposure of the action 22 to excessive gas pressures and flow rates. In addition, the user can make fine adjustments to the degree of attenuation of the flow-rate and pressure introduced by the flow restrictor device 54, to optimize the attenuation for a particular firearm 10 and suppressor combination. These features also can be used to restrict and adjust the flow of the propellant gas G to suit a particular type of cartridge 30.

Description of the Gas Tube Assembly

Figure 15:
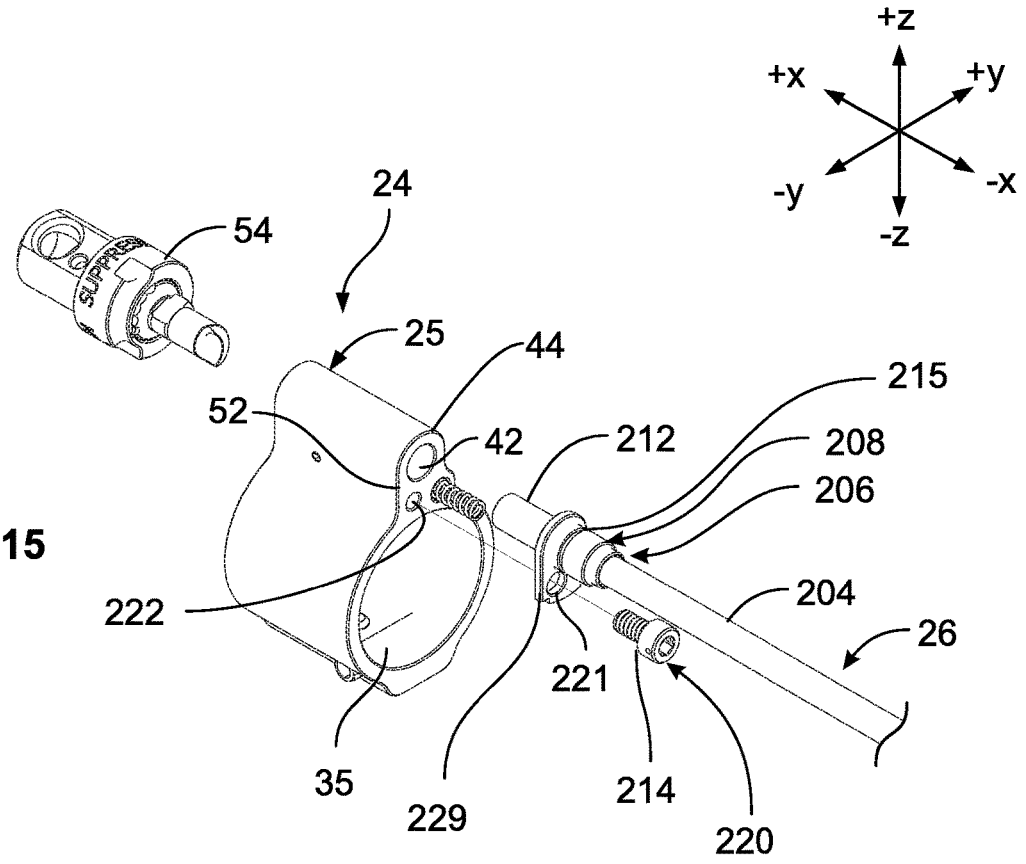
FIG. 15 is a partially exploded rear perspective view of the gas tube assembly of the firearm shown in FIGS. 1 and 2; and the gas block assembly shown in FIGS. 4-14F.
Figure 16:
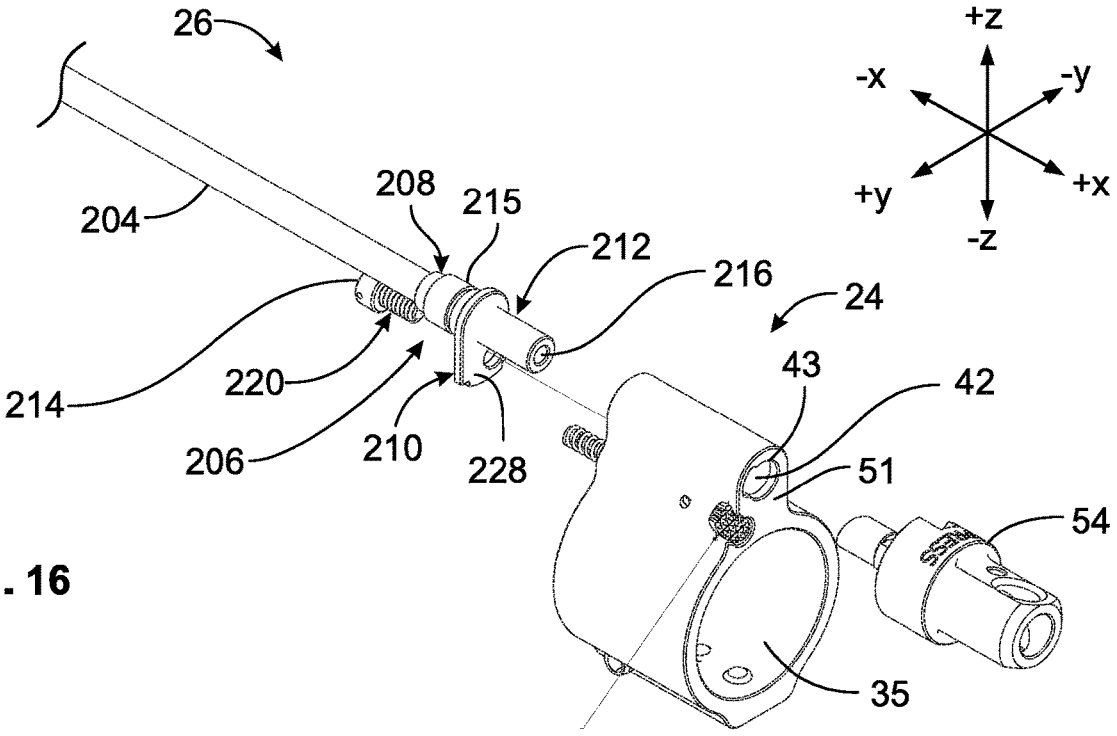
FIG. 16 is a partially exploded front perspective view of the gas block assembly and the gas tube assembly shown in FIGS. 4-15.
Figure 20:
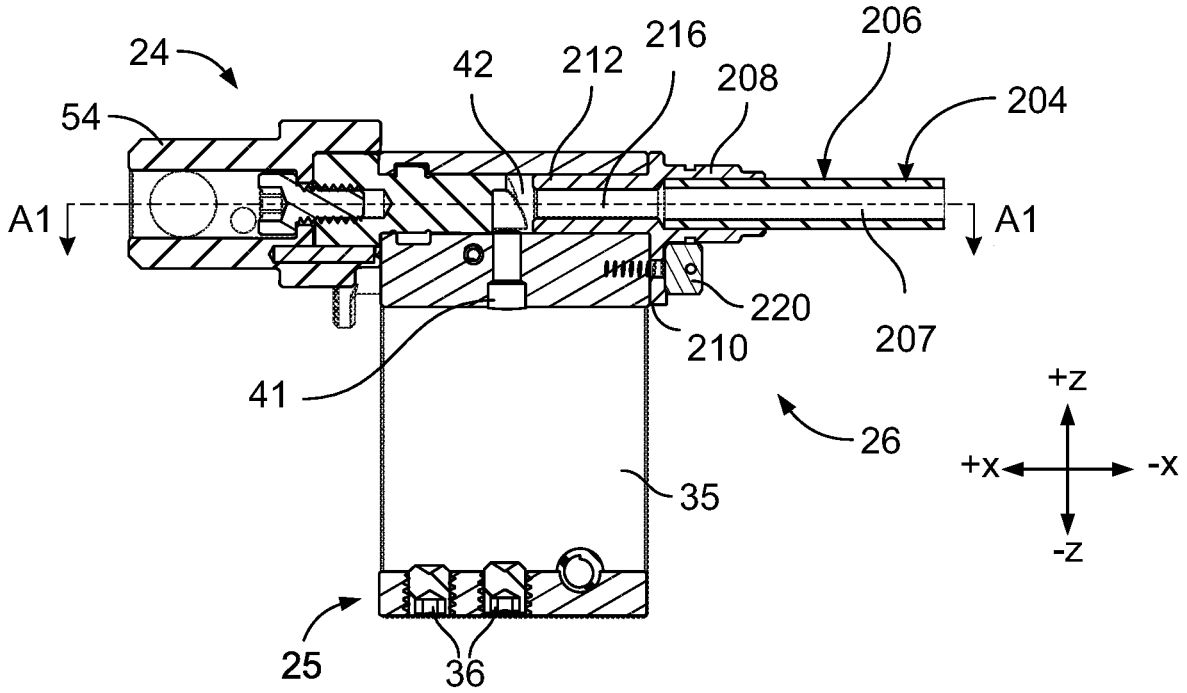
FIG. 20 is a cross-sectional view of the gas block assembly and the gas tube assembly shown in FIGS. 4-19, taken through the line "A-A" of FIG. 19, and depicting the gas tube assembly mated with the gas block assembly.
Figure 21:
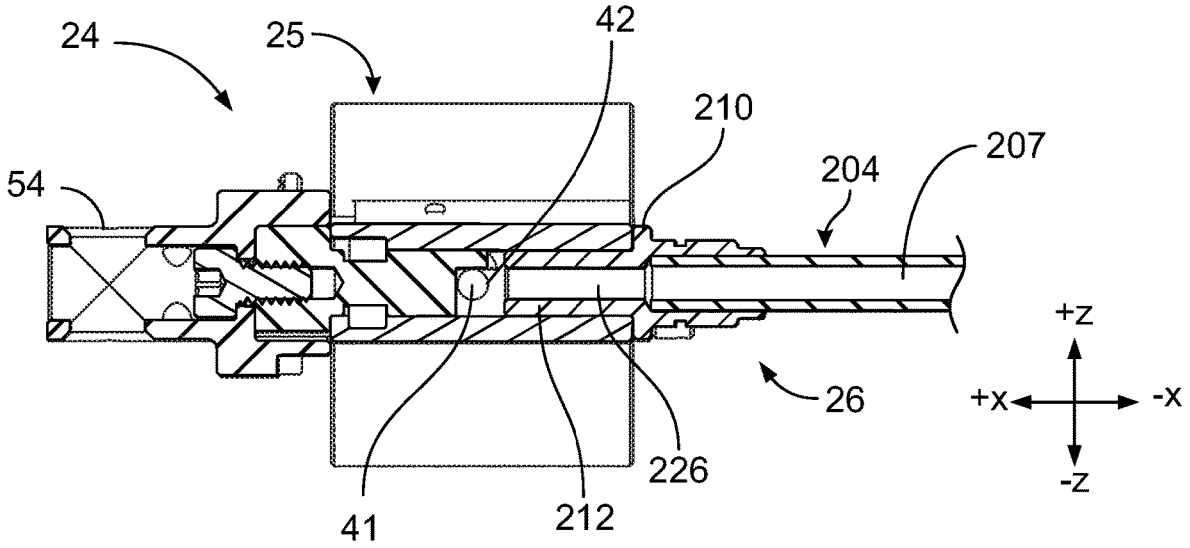
FIG. 21 is a cross-sectional view of the gas block assembly and the gas tube assembly shown in FIGS. 4-20, taken through the line "A1-A1" of FIG. 20, and depicting the gas tube assembly mated with the gas block assembly.

Referring to FIGS. 15-21, the gas tube assembly 26 includes the gas tube 204, and a mating portion 206. The gas tube 204 defines an internal passage 207 extending between the forward and rearward ends of the gas tube 204, as can be seen in FIGS. 16, 20, and 21. The gas tube 204 can be formed from stainless steel. Other materials having sufficient rigidity and strength to contain the pressurized propellant gas G can be used in the alternative.

The gas tube 204 can have an outer diameter of about 0.156 inch to about 0.375 inch, such as about 0.18 inch; an inner diameter of about 0.118 inch to about 0.25 inch, such as about 0.118 inch; and an overall length of about 8 inches to about 20 inches, such as about 14 inches to about 18.5 inches. As used herein, the term "about" in reference to a numerical value means plus or minus 15 percent of the numerical value of the number with which it is being used. Also, specific dimensions for the gas block 25 and gas tube assembly 26 are presented herein for exemplary purposes only, and unless expressly stated otherwise are not intended to limit the scope of the appended claims; alternative embodiments of the gas block 25 and gas tube assembly 26 can have dimensions other than those specified herein.

Figure 18:
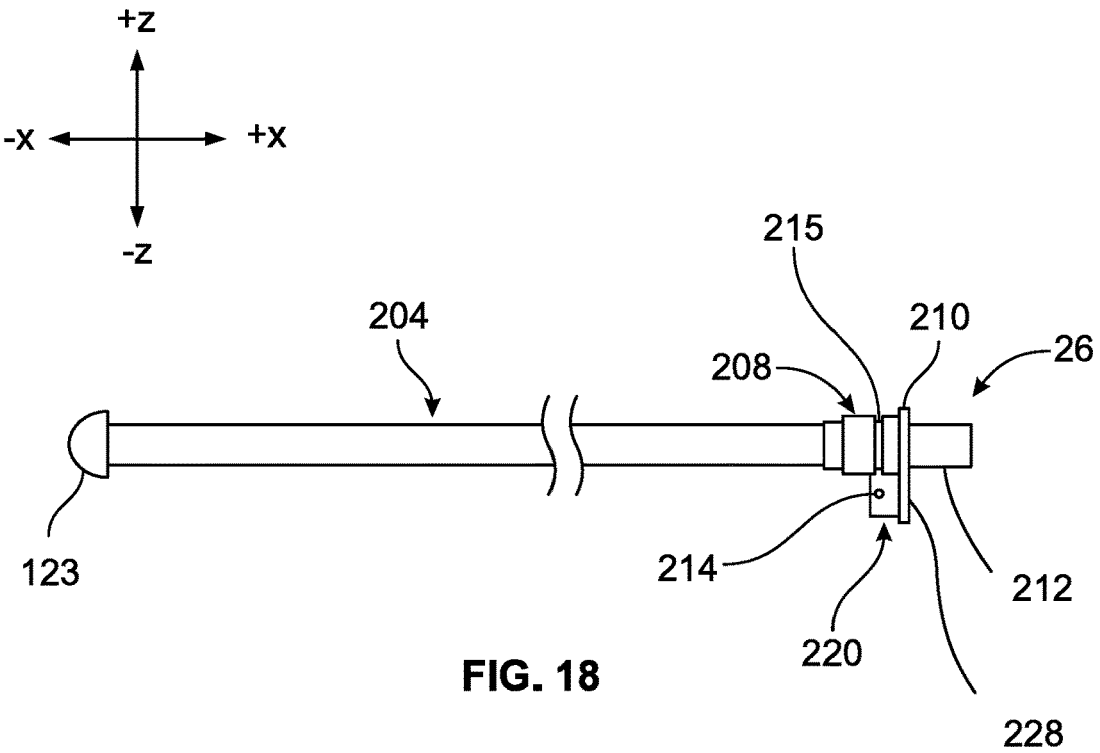
FIG. 18 is a side view of the gas tube assembly shown in FIGS. 15-17.
Figure 19:
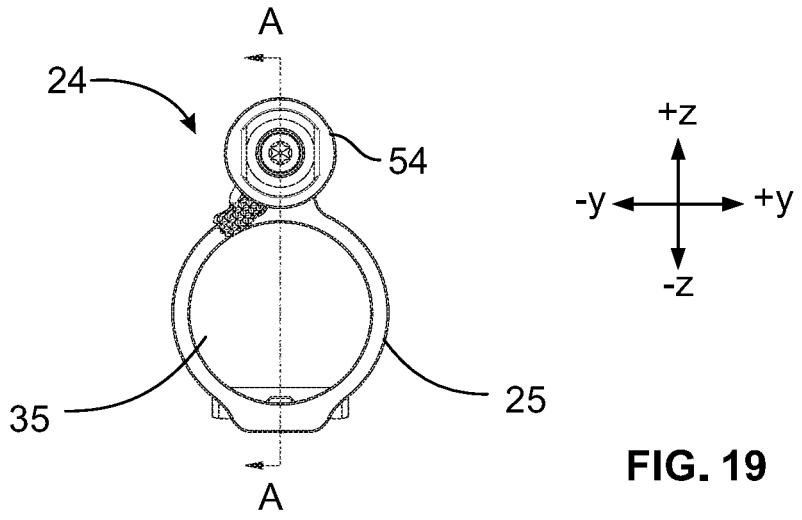
FIG. 19 is a front view of the gas block assembly and the gas tube assembly shown in FIGS. 4-18.

The mating portion 206 includes a sleeve 208, a flange 210, and an insert 212, as depicted in FIGS. 15, 16, and 18. The mating portion 206 can be formed from stainless steel; other types of materials can be used in the alternative. The sleeve 208 is configured to fit over the forward end of the gas tube 204, with minimal, or no clearance between the outer surface of the gas tube 204 and the inner surface of the sleeve 208, as can be seen in FIGS. 20 and 21. The sleeve 208 can be secured to the gas tube 204 by a suitable technique such as brazing.

The flange 210 adjoins the sleeve 208. The flange 210 extends downwardly, from the perspective of FIGS. 15-21, and has a through hole 221 formed therein. The flange 210 has a substantially planar, forward facing surface 228; and a substantially planar, rearward facing surface 229 as can be seen in FIGS. 15 and 16. The flange 210 can have a maximum height ("z" dimension) of about 0.5 inch to about 0.6 inch; a maximum width ("y" dimension) of about 0.3 inch to about 0.45 inch; and a thickness ("x" dimension) of about 0.04 inch to about 0.08 inch.

The insert 212 adjoins a forward side of the flange 210. The insert 212 is substantially cylindrical, and has an internal passage 216 extending between its forward and rearward ends. The passage 216 is in fluid communication with the passage 207 of the gas tube 204 when the gas tube assembly 26 is mated with the gas block 25, as can be seen in FIGS. 20 and 21.

The insert 212 is received by the gas tube receiving passage 42 of the gas block 25, by way of the aperture 44 formed in the rearward surface 52 of the gas block 25, as shown in FIGS. 20 and 21. The diameter of the insert 212 is chosen so that the insert 212 fits within the gas tube receiving passage 42 with minimal, or no clearance between the outer surface of the insert 212 and the adjacent surface of the gas block 25, to help minimize leakage of the propellant gas G past the interface between the gas block 25 and the mating portion 206. The diameter of the insert 212 can be about 0.18 inch to about 0.25 inch. The length of the insert 212 can be about 0.375 inch to about 0.5 inch. The diameter of the internal passage 216 can be about 0.06 inch to about 0.11 inch.

Figure 17:
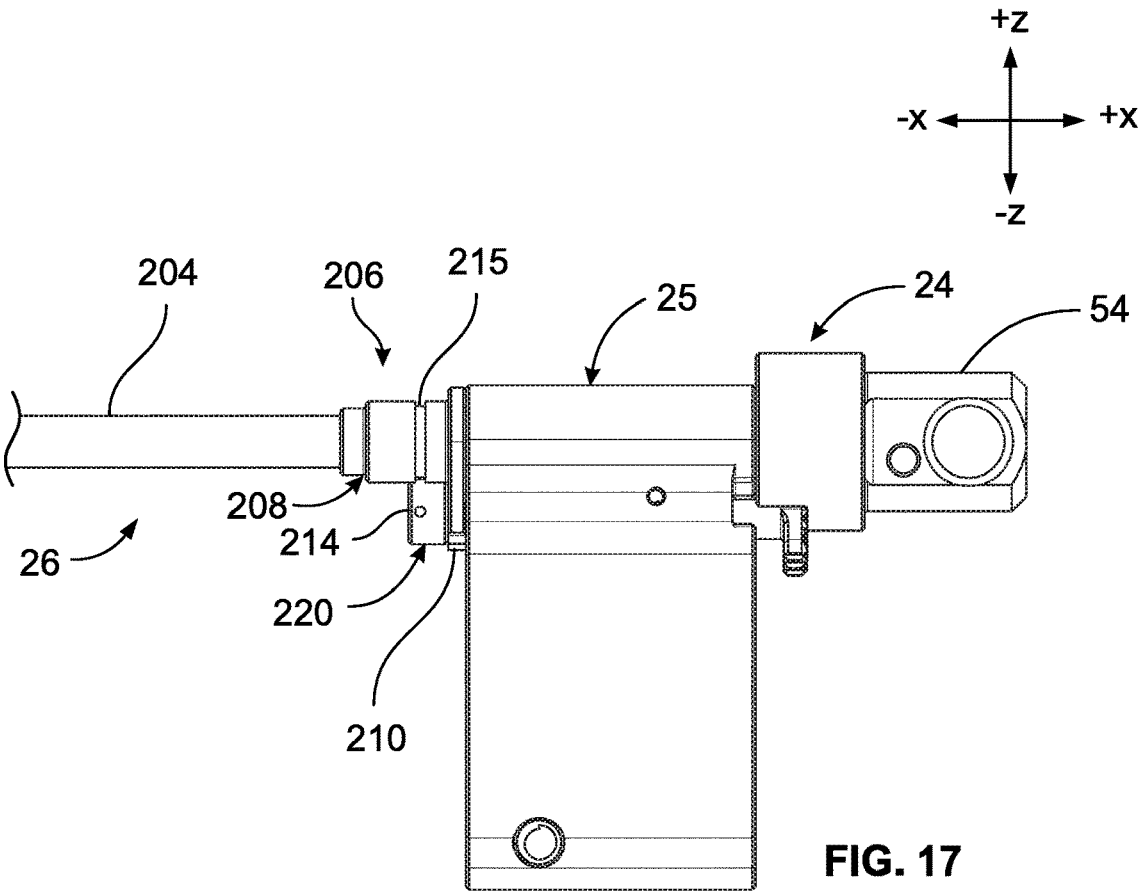
FIG. 17 is a side view of the gas block assembly and the gas tube assembly shown in FIGS. 4-16, depicting the gas tube assembly mated with the gas block assembly.

The flange 210 is positioned so that the forward-facing surface 228 of the flange 210 abuts the rearward surface 52 of the gas block 25 when the insert 212 has been fully inserted into the gas tube receiving passage 42, as shown in FIG. 17. The flange 210 is secured to the gas block 25 by a fastener 220 that extends through the flange 210 via a hole 221 formed therein. A threaded shaft of the fastener 220 engages internal threads within a hole 222 formed in the gas block 25, while the head of the fastener 220 abuts the rearward-facing surface 229 of the flange 210. In alternative embodiments, an O-ring gasket or other suitable means can be positioned between the flange 210 and rearward surface 52 of the gas block 25 to further minimize leakage of the propellant gas G.

The internal passage 216 of the insert 212, and the adjoining passage 207 of the gas tube 204, are in fluid communication with the gas tube receiving passage 42 of the gas block 25 when the insert 212 is positioned within the gas tube receiving passage 42, as can be seen in FIGS. 20 and 21. The flange 210 and the fastener 220 restrain the gas tube assembly 26 from both linear and rotational movement in relation to the gas block 25 and the gas key 27. In particular, interference between the head of the fastener 220 and the rearward facing surface 229 of the flange 210 prevents the mating portion 206 from backing out of the gas tube receiving passage 42. Forward ("+x" direction) movement of the gas tube 204 is inhibited by interference between the forward facing surface 228 of the flange 210 and the rearward surface 52 of the gas block 25. In addition, the fastener 220 exerts a reactive force on the flange 210 in response to external torque applied to the gas tube assembly 26, which in turn restrains to gas tube assembly 26 from rotating in relation to the gas block 25 and the gas key 27.

The head of the fastener 220 can include a hole 214, and the sleeve 208 of the mating portion 206 can include a circumferentially-extending slot 215 that accommodate safety wire. The safety wire can be used at the option of the user to additionally secure the fastener 220 once it has been tightened. Other means for additionally securing the fastener 220, such as a lock washer, a self-locking fastener, or thread-locking fluid, can be used in the alternative.

Other means for securing the flange 210 to the gas block 25 can be used in lieu of the fastener 220. For example, alternative embodiments can include a threaded post that is permanently secured to gas block 25 by an interference fit or other suitable means, and extends from the rearward surface 52 of the gas block 25. The post can be received by the through hole 221 in the flange 210 when the gas tube assembly 26 is mated with the gas block 25; and the flange 210 can be secured to the post by a nut. In other alternative embodiments, the post can be unthreaded, and the flange 210 can be secured to the post by a cotter pin, E-CLIP, or other suitable means. In other alternative embodiments, a latching mechanism that extends through the through hole 221 and latches securely over the flange 210 can be used in lieu of the fastener 220. In still other alternative embodiments, the flange 210 can be attached directly to the gas tube 204, and the forward end of the gas tube 204 can be configured to be received by the gas tube receiving passage 42 of the gas block 25. In such embodiments, the mating portion of the gas tube assembly is made up entirely by the flange 210.

The rearward end of the gas tube 204 is positioned within a gas tube receiving passage 29 formed in the gas key 27 and visible in FIG. 3. The gas tube 204 can have features, such as a tapered end portion 123 shown in FIG. 17, that discourage leakage of the propellant gas G past the interface between the gas tube 204 and the gas key 27.

The gas tube assembly 26 can be mated with the gas block 25 by inserting the insert 212 of the mating portion 206 of the gas tube assembly 26 into the gas tube receiving passage 42 of the gas block 25 by way of the rearward aperture 44. The insert 212 is inserted until the forward-facing surface 228 of the flange 210 abuts the rearward surface 52 of the gas block 25. The fastener 220 then can be installed in the hole 221 in the gas block 25, to secure the gas tube assembly 26 to the gas block 25. The gas tube assembly 26 can be de-mated from the gas block 25 by removing the fastener 220, and pulling the insert 212 out of the gas tube receiving passage 42.

Thus, the gas tube assembly 26 can be mated with, and de-mated from the gas block 25 quickly and easily, and without the use of any tooling other than the screwdriver or wrench needed to tighten and loosen the fastener 220. The removal and reinstallation of the gas tube assembly 26, therefore, does not present an impediment to the maintenance, repair, or disassembly of the firearm 10, in contrast to conventional gas tubes held in place by a press-fit pin or other means of attachment that may be relatively difficult to install and remove.

We claim:

1. A system for directing propellant gases between a barrel and an action of a firearm, the barrel defining: a bore configured to receive and guide a projectile as the projectile is propelled through the bore by a propellant gas; and a first gas port extending between the bore and an exterior surface of the barrel; the system comprising:

a gas block configured for mounting on the barrel, wherein: the gas block defines a first passage configured to receive the barrel, a second passage, and a second gas port that adjoins the second passage; and the gas block is configured so that the second gas port is in fluid communication with the first gas port when the gas block is mounted on the barrel; and a gas tube assembly comprising: (i) a gas tube defining a passage extending between a forward and a rearward end of the gas tube, the passage in the gas tube being in fluid communication with the second passage in the gas block and the action; (ii) a mating portion secured to the gas tube and comprising an insert, and a flange connected to the insert; and (iii) an elongated member secured to the gas block and configured to restrain the gas tube and the mating portion from linear and rotational movement in relation to the gas block, wherein: the insert is positioned within the second passage of the gas block and has a passage formed therein;

the passage in the insert is in fluid communication with the second passage in the gas block, and with the passage in the gas tube; and the flange is configured to receive the elongated member.

2. The system of claim 1, wherein the mating portion is mounted on a forward end of the gas tube, and a rearward end of the gas tube is configured to mate with a gas key of the firearm.

3. The system of claim 2, wherein the mating portion further comprises a sleeve positioned over the forward end of the gas tube.

4. The system of claim 1, wherein the insert and the second passage in the gas block are substantially cylindrical, and an outer diameter of the insert is approximately equal to a diameter of the second passage.

5. A firearm comprising the system of claim 1.

6. The system of claim 1, wherein the insert adjoins that flange.

7. The system of claim 1, wherein the elongated member is a bolt.

8. The system of claim 1, wherein the elongated member is a threaded post and the flange is secured to the threaded post by a nut.

9. The system of claim 1, wherein the elongated member is a post and the flange is secured to the post by a cotter pin or a clip.

10. A system for directing propellant gases between a barrel and an action of a firearm, the barrel defining: a bore configured to receive and guide a projectile as the projectile is propelled through the bore by a propellant gas; and a first gas port extending between the bore and an exterior surface of the barrel; the system comprising:

a gas block configured for mounting on the barrel, wherein: the gas block defines a first passage configured to receive the barrel, a second passage, and a second gas port that adjoins the second passage; and the gas block is configured so that the second gas port is in fluid communication with the first gas port when the gas block is mounted on the barrel; and a gas tube assembly comprising: (i) a gas tube defining a passage extending between a forward and a rearward end of the gas tube, the passage in the gas tube being in fluid communication with the second passage in the gas block and the action; (ii) a flange secured to the gas tube; and (iii) an elongated member secured to the gas block and configured to restrain the gas tube and the flange from linear and rotational movement in relation to the gas block, wherein:

a forward end of the gas tube is positioned within the second passage of the gas block;

the passage in the gas tube is in fluid communication with the second passage in the gas block; and the flange is configured to receive the elongated member.

11. The system of claim 10, wherein the elongated member is a bolt.

12. The system of claim 10, wherein the elongated member is a threaded post and the flange is secured to the threaded post by a nut.

13. The system of claim 10, wherein the elongated member is a post and the flange is secured to the post by a cotter pin or a clip.

14. A firearm comprising the system of claim 10.

* * * * *